US007204955B2

(12) United States Patent
Vincent

(10) Patent No.: US 7,204,955 B2
(45) Date of Patent: Apr. 17, 2007

(54) CASTING LADLE

(75) Inventor: Mark Vincent, Bedfordshire (GB)

(73) Assignee: Pyrotek Engineering Materials Limited, Milton Keynes (GB)

( * ) Notice: Subject to any disclaimer, the term of this patent is extended or adjusted under 35 U.S.C. 154(b) by 0 days.

(21) Appl. No.: 10/944,340

(22) Filed: Sep. 17, 2004

(65) Prior Publication Data

US 2005/0077661 A1 Apr. 14, 2005

(30) Foreign Application Priority Data

Oct. 11, 2003 (GB) ..... 0324025.6

(51) Int. Cl.
*C21B 3/00* (2006.01)

(52) U.S. Cl. ..... 266/275; 266/280; 432/264

(58) Field of Classification Search ..... 266/275, 266/280; 432/264
See application file for complete search history.

(56) References Cited

U.S. PATENT DOCUMENTS

| | | | | |
|---|---|---|---|---|
| 4,690,867 | A | 9/1987 | Yamamoto et al. | |
| 4,888,311 | A | 12/1989 | Davidovits et al. | |
| 5,011,120 | A * | 4/1991 | Bear | 266/240 |
| 5,132,178 | A * | 7/1992 | Chyung et al. | 428/372 |
| 5,880,046 | A * | 3/1999 | Delvaux et al. | 501/123 |
| 2001/0024726 | A1* | 9/2001 | Hanzawa et al. | 428/408 |

FOREIGN PATENT DOCUMENTS

| | | |
|---|---|---|
| EP | 0 815 994 | 1/1998 |
| EP | 1 086 936 | 3/2001 |
| GB | 1 311 508 | 3/1973 |
| JP | 10-296427 | 11/1998 |

OTHER PUBLICATIONS

English language translation of Japanese 10-296427, published Nov. 1998.*

G.B. Search Report dated Jan. 30, 2004 and issued to the priority application, Jan. 2004.

* cited by examiner

*Primary Examiner*—Scott Kastler
(74) *Attorney, Agent, or Firm*—Knobbe, Martens, Olson & Bear, LLP

(57) ABSTRACT

A casting ladle has a body (2) with a base (3) and walls (4, 6, 8) made of a laminated composite ceramic material that includes multiple layers of a woven fiber reinforcing fabric embedded in a ceramic matrix. A rigid support element (20) for attaching the ladle to a handling device is embedded within the composite ceramic material. In a preferred form, the reinforcing fabric is made of woven glass and the matrix material includes calcium silicate and silica.

19 Claims, 5 Drawing Sheets

CASTING LADLE

BACKGROUND OF THE INVENTION

1. Field of the Invention

The present invention relates to a casting ladle for use in metal foundries and in particular, but not exclusively, to a ladle for casting aluminium and aluminium alloys, and other non-ferrous metals such as zinc.

2. Description of the Related Art

In aluminium foundries where castings are made using either high pressure die casting or gravity die casting techniques, ladles are normally used for transporting pre-measured quantities of liquid metal from a holding furnace to a casting machine and then pouring the liquid metal into a receptacle of the casting machine. For large scale production processes, the ladle is normally mounted on a mechanical or robotic handling device, which is programmed to dip the ladle into the holding furnace to obtain a measured quantity of liquid metal, and then transport the metal and pour it into the casting machine. For smaller scale production processes, the ladle can be handled manually. The capacity of the ladle is usually quite small (generally between 0.5 and 50 kg of liquid aluminium) and the metal is normally held in the ladle for quite a short time (e.g. less than 60 seconds).

Traditionally, casting ladles have been made of cast iron. This material has the advantage that it can withstand the high temperatures involved and it is very tough. However, it also has the disadvantages that it is attacked by the liquid aluminium and it is very dense (approximately 7000 kg/cm3). Ladles made of this material are therefore very heavy, which causes handling problems and requires the use of powerful handling equipment. Cast iron also has a high thermal conductivity, which causes the liquid metal to lose heat very quickly. The furnace therefore has to be maintained at a temperature that is significantly above the casting temperature to allow for a loss in temperature as the metal is transported, and this results in high energy costs. Casting ladles made of cast iron also have a high maintenance requirement as they must be been cleaned after each casting operation to remove any metal that has solidified and become stuck to the ladle. The ladle must also be coated with a release agent at frequent intervals, for example every one or two days.

In order to reduce some of these difficulties, it is known to coat the casting ladle with a refractory or ceramic coating. However, this is difficult to achieve in practice, since the differential thermal expansion rates of the coating and the underlying cast iron can cause cracking of the coating. Also, most ceramic and refractory coatings are either fragile or wear quickly, and therefore only have a limited lifetime.

It is also known to make casting ladles from cement based refractory materials or from ceramic materials, some of these materials including steel or fiber reinforcements. For example, JP10296427A describes a casting ladle made of a ceramic fiber material, which is reinforced with metal strips and a sheet of a heat resistant woven fabric material. However, ladles made of such materials are generally fragile and/or suffer high wear in use. In addition, there are often problems with attaching ladles made of these materials to mechanical handling devices in such a way that the ladle is adequately supported and does not suffer mechanical failure in use. Such ladles have not therefore gained widespread acceptance.

It is an object of the present invention to provide a casting ladle that mitigates at least some of the aforesaid disadvantages.

SUMMARY OF THE INVENTION

According to the present invention there is provided a casting ladle having a body with a base and walls made of a composite ceramic material that includes a woven fiber reinforcing fabric embedded within a ceramic matrix; characterised in that the composite ceramic material is a laminated material including multiple layers of woven fiber reinforcing fabric that extend throughout the base and walls of the ladle, and a rigid support element for attaching the ladle to a handling device is embedded within the composite ceramic material.

Composite ceramic materials are very light as compared to cast iron, and ladles made of this material are therefore much easier to handle than traditional cast iron ladles. This allows less powerful handling equipment to be used and/or larger quantities of liquid metal to be transported. They also have a very low thermal conductivity, and the liquid metal therefore loses heat far less rapidly than in a cast iron ladle. This allows the temperature of the foundry furnace to be reduced, leading to a significant saving in energy costs. We have also found that this can lead to a significant reduction in cracking of the moulded products, and therefore a reduced rejection rate.

Another advantage of the ceramic composite material is that it is not wetted by the liquid metal. The metal therefore pours easily from the ladle, leaving the ladle clean. Also, because it has a lower thermal conductivity than cast iron, the metal does not solidify as quickly within the ladle. It is therefore unnecessary to clean the ladle between casting operations. Furthermore, a release agent applied to the ladle lasts much longer than with a cast iron ladle, so further reducing maintenance requirements and production costs.

The composite ceramic material is a laminated material that includes multiple layers of woven fiber reinforcing fabric, which extend throughout the base and walls of the ladle. As a result, the ladle is very strong and durable, and is entirely self-supporting, thereby avoiding the need for an internal metal shell. The composite ceramic material preferably includes between two and twenty-five layers of reinforcing fabric, preferably between four and twenty layers. Typically, a casting ladle may include approximately ten layers of reinforcing fabric. The reinforcing fabric is preferably made of woven glass.

The casting ladle includes a support element, which allows the ladle to be attached easily to a handling device such as a mechanical or robotic arm, or one or more manual lifting handles.

The matrix material may comprise various ceramic materials, including fused silica, alumina, mullite, silicon carbide, silicon nitride, silicon aluminium oxy-nitride, zircon, magnesia, zirconia, graphite, calcium silicate, boron nitride (solid BN), aluminium nitride (AlN) and titanium diboride (TiB2), or a mixture of these materials. Preferably, the matrix material is calcium based, and more preferably includes calcium silicate (wollastonite) and silica. Advantageously, the matrix material consists of approximately 60% by wt wollastonite and 40% by wt solid colloidal silica. The composite material is preferably a mouldable refractory composition as described in U.S. Pat. No. 5,880,046, the entire content of which is by reference incorporated herein.

Advantageously, the ladle includes a non-stick surface coating. Preferably, the coating includes boron nitride.

The ladle may have a wall thickness of between 5 and 25 mm, preferably approximately 12 mm. The ladle may have a capacity of between 0.5 and 50 kg, preferably between 1 kg and 20 kg of liquid aluminium. Typically, the ladle may have a capacity of approximately 5 kg.

The support element may include a rigid frame element and/or one or more mounting elements for attaching the ladle to a handling device. The support element is preferably located between adjacent layers of reinforcing fabric and may for example be made of steel. The support element may include an elastomeric covering, for example of rubber, to absorb differential thermal expansion of the frame and the ceramic material. The coating may be full or partial, and may have a thickness of 0 mm–3.0 mm, typically approximately 1.5 mm. The support element may extend around the circumference of the casting ladle, or it may be only partial: for example, it may be embedded within the side walls of the ladle.

BRIEF DESCRIPTION OF THE DRAWINGS

Certain embodiments of the invention will now be described, by way of example, with reference to the accompanying drawings, in which.

DETAILED DESCRIPTION OF THE PREFERRED EMBODIMENT

Figure 1:
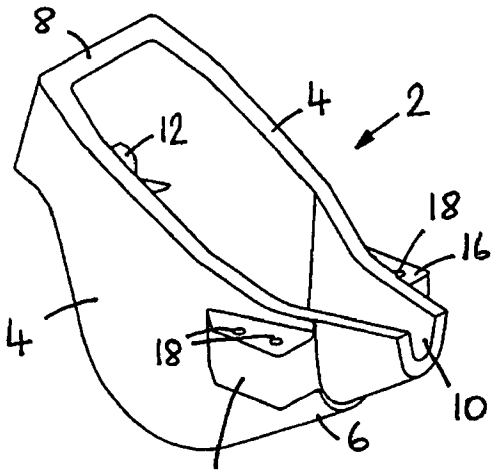
FIG. 1 is an isometric view of a first casting ladle according to the invention.
Figure 5:
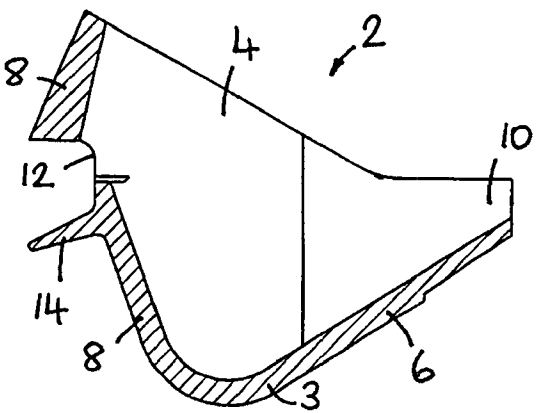
FIG. 5 is a side section of the first casting ladle, on line V—V of FIG. 2.
Figure 4:
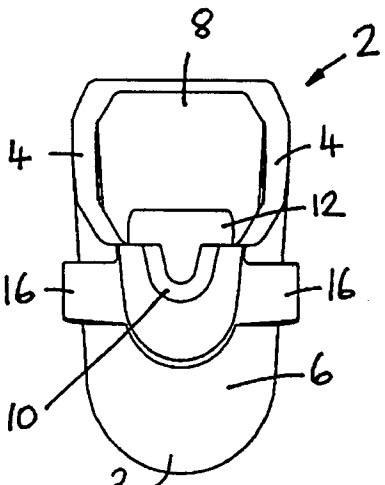
FIG. 4 is a front elevation of the first casting ladle.
Figure 2:
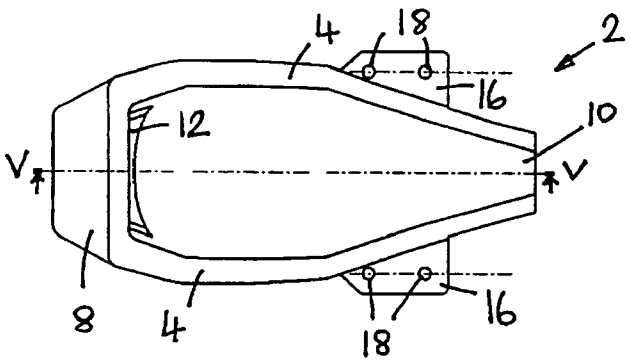
FIG. 2 is a plan view of the first casting ladle.
Figure 3:
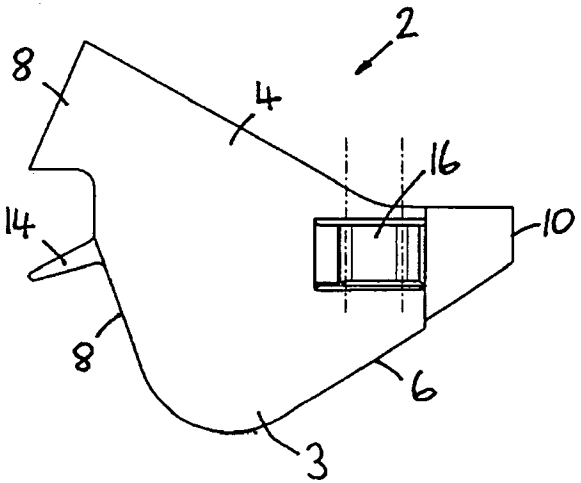
FIG. 3 is a side elevation of the first casting ladle.

The casting ladle shown in FIG. 1 comprises an open topped vessel 2 having a base 3, two side walls 4, an inclined front wall 6, an inclined rear wall 8, and a pouring spout 10. An inlet opening 12 is provided in the rear wall 8, below which there is provided an outwardly extending scraper fin 14. A mounting block 16 is provided on each side of the ladle, each mounting block having two cylindrical bores 18 for receiving mounting bolts (not shown). The mounting blocks 16 are used for attaching the ladle to a handling device, such as a robotic arm or one or more manual lifting handles (not shown).

The ladle shown in FIG. 1 has a capacity of approximately 2 litres and is capable of carrying approximately 5 kg of liquid aluminium. The wall thickness of the ladle is generally approximately 12 mm, and ranges from approximately 8 mm adjacent the spout 10 to approximately 20 mm above the inlet opening 12.

The casting ladle is made from a laminated composite ceramic material that includes numerous layers of a woven fiber reinforcing fabric embedded in a ceramic matrix. The woven fiber reinforcing fabric extends throughout the base and walls of the ladle and is preferably made of woven glass. Various materials may be used for the ceramic matrix, including fused silica, alumina, mullite, silicon carbide, silicon nitride, silicon aluminium oxy-nitride, zircon, magnesia, zirconia, graphite, calcium silicate, boron nitride, aluminium nitride and titanium diboride, or a mixture of these materials. Preferably, the ceramic matrix includes calcium silicate (wollastonite) and silica and comprises a mouldable refractory composition as described in U.S. Pat. No. 5,880,046. The ladle typically has between two and twenty-five layers of the reinforcing fabric, typically approximately ten layers.

The ladle preferably has a non-stick coating applied at least to its inner surface, for example of boron nitride.

Figure 6:
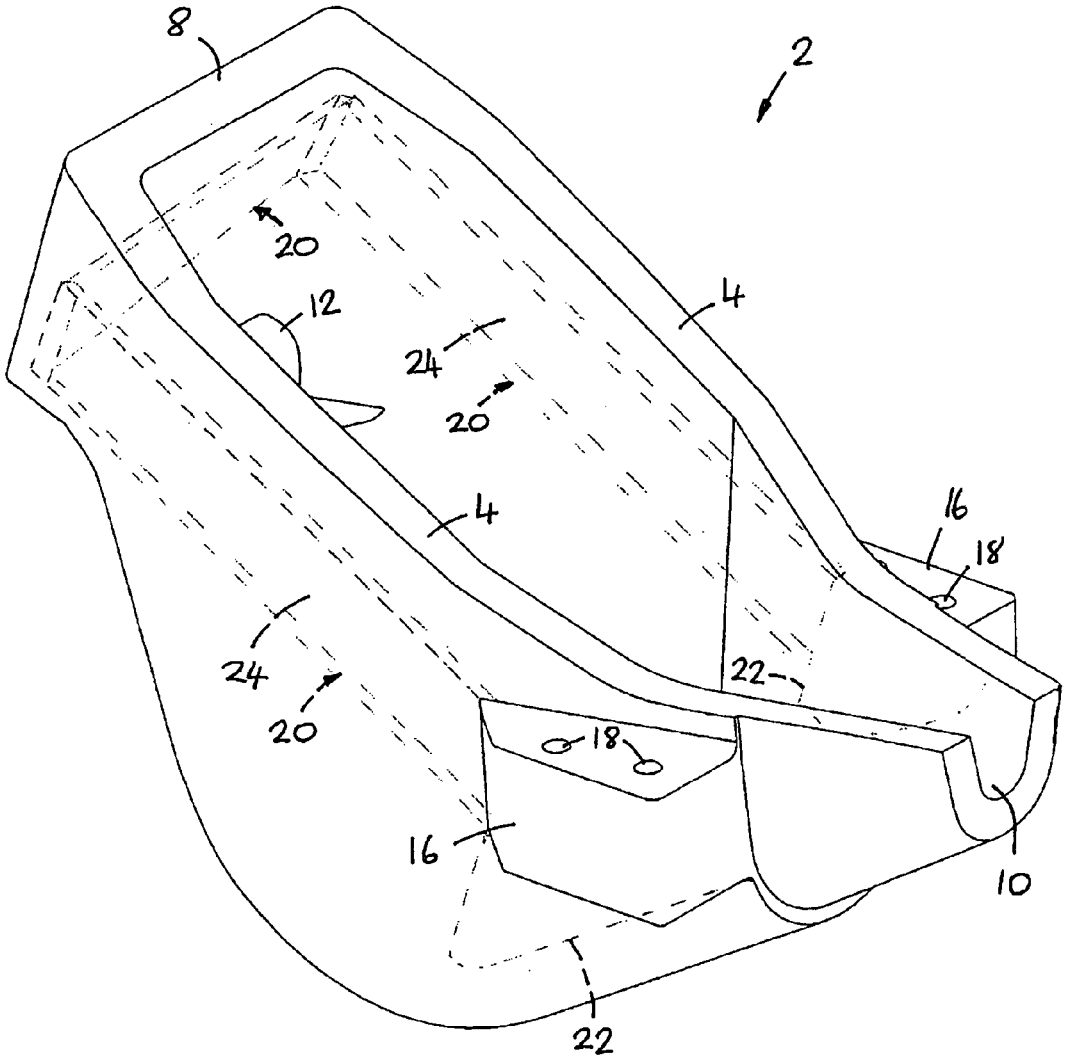
FIG. 6 is an isometric view of the first casting ladle, showing in broken lines a support frame embedded in the ladle.
Figure 7:
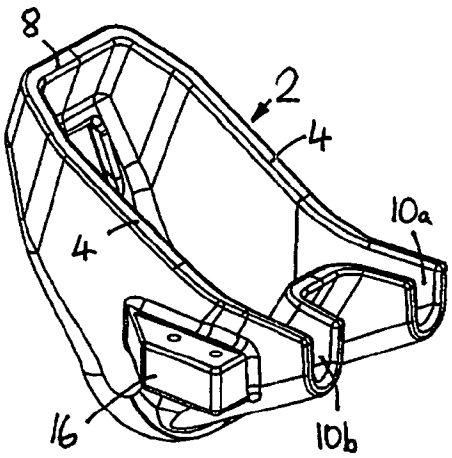
FIG. 7 is an isometric view of a second casting ladle according to the invention.
Figure 12:
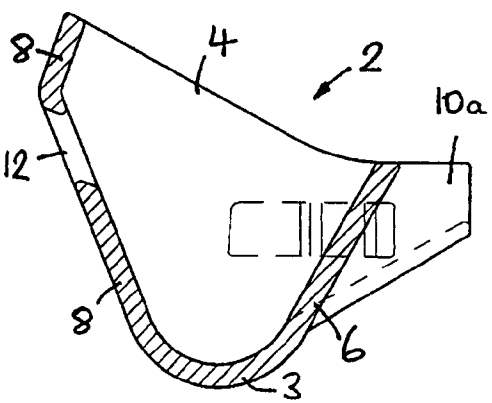
FIG. 12 is a side section of the second casting ladle, on line XII—XII of FIG. 8, and FIGS. 13 and 14 are isometric views of alternative support frames for a casting ladle.
Figure 9:
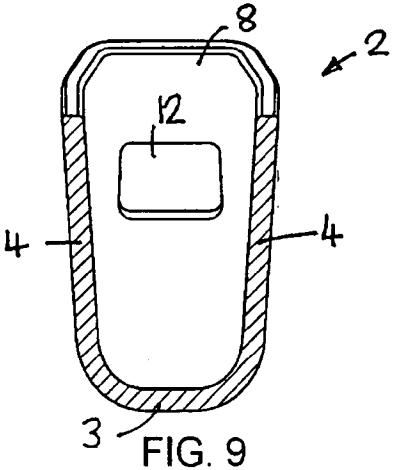
FIG. 9 is a sectional view of the second casting ladle on line IX—IX of FIG. 8.
Figure 11:
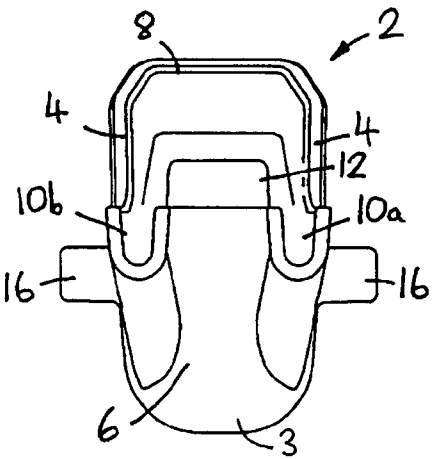
FIG. 11 is a front elevation of the second casting ladle.
Figure 8:
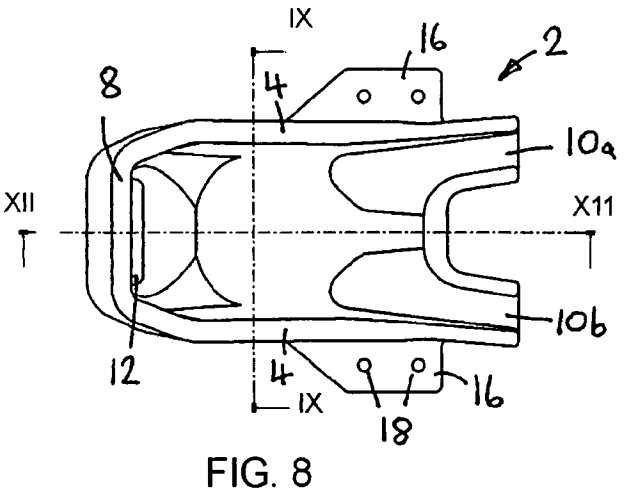
FIG. 8 is a plan view of the second casting ladle.
Figure 10:
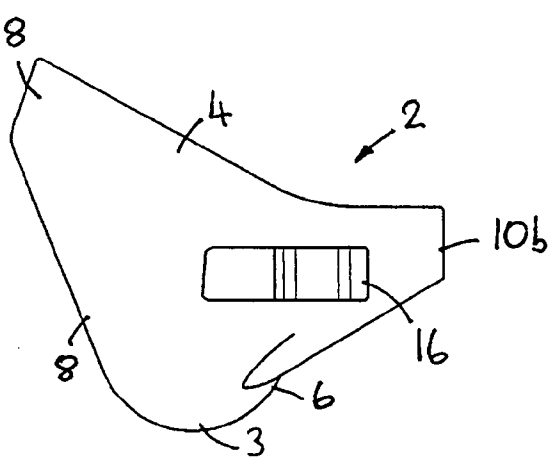
FIG. 10 is a side elevation of the second casting ladle.

The ladle includes a rigid steel support frame 20 for attaching the ladle to a handling device. The support frame is shown in broken lines in FIG. 6. The support frame 20 is embedded within the composite ceramic material between adjacent layers of the reinforcing fabric and includes two mounting elements in the form of support plates 22 that are located within the mounting blocks 16, and a substantially rectangular frame structure 24 that extends along both side walls 4 and across the rear wall 8. The steel frame 20 preferably has a coating of an elastomeric material, in order to absorb any differential thermal expansion between the frame and the ceramic matrix. The elastomeric material may for example be a rubber coating with a thickness of 0 mm–3.0 mm, typically approximately 1.5 mm.

Figure 13:
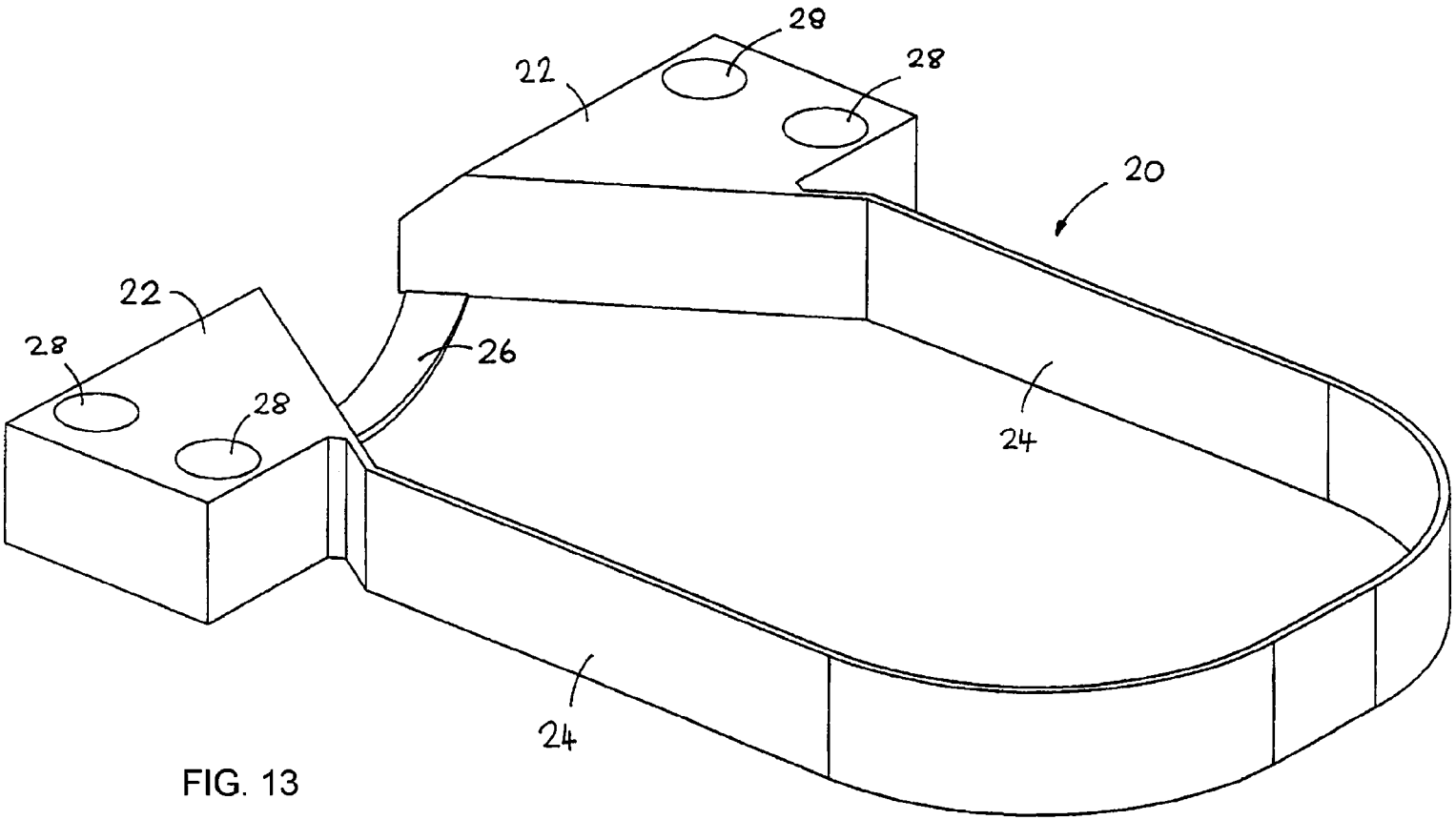
Figure 14:
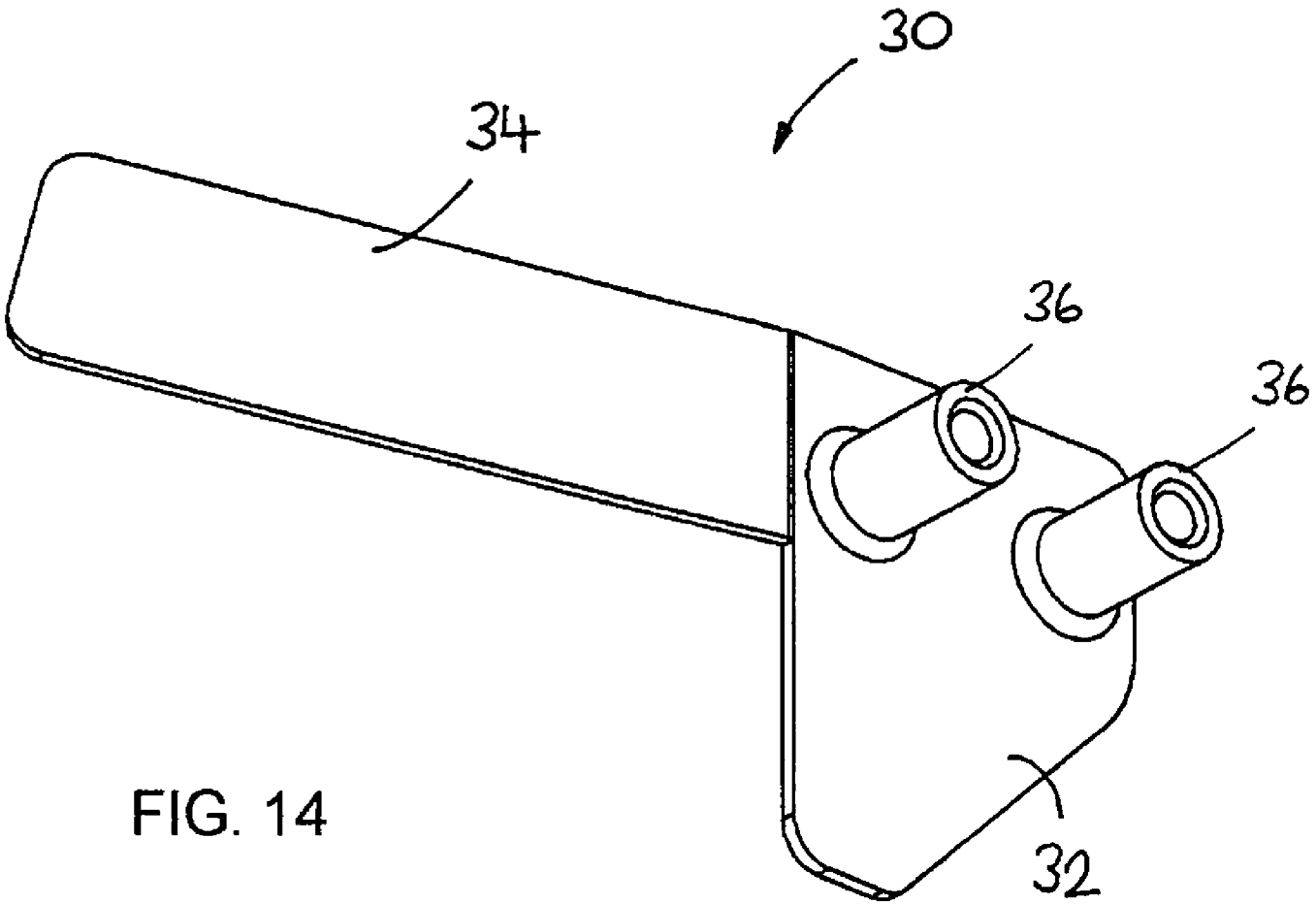

Two alternative forms of the support frame are shown in FIGS. 13 and 14. In the first alternative form shown in FIG. 13, the support frame 20 includes two support plates 22 that are located within the mounting blocks 16, and a substantially rectangular frame structure 24 that extends along both side walls 4 and across the rear wall 8. The frame also includes a curved connecting element 26 that is embedded beneath the pouring spout 10 and two pairs of bores 28 in the support plates 22 for mounting bolts (not shown). The frame 20 has a rubber coating to absorb any differential thermal expansion between the frame and the ceramic matrix, which has a thickness of 0 mm–3.0 mm. The rubber coating may optionally be omitted from one surface of the frame (preferably the inner face), to allow direct contact between the ceramic matrix and that surface of the frame and reduce movement between the frame and the ladle. Any differential thermal expansion is then absorbed by the coating provided on the remaining surfaces of the frame.

The second alternative form of the support frame shown in FIG. 14 consists of a pair of half frames 30 that are embedded within the ceramic matrix on either side of the ladle. Each half frame 30 includes a support plate 32 and a frame element 34 that extends along the side wall 4 of the ladle. Each support plate 32 carries two threaded cylindrical bushes 36, for receiving mounting bolts. The frame 30 has a full or partial rubber coating to absorb differential thermal expansion between the frame and the ceramic matrix, which has a thickness of 0 mm–3.0 mm.

A method of manufacturing the casting ladle will now be described. First, the ceramic matrix material is made up by blending together the components of that material, for example as described in U.S. Pat. No. 5,880,046. The component materials may, for example, consist of approximately 60% by wt wollastonite and 40% by wt solid colloidal silica. These materials are blended together to form a slurry.

The ladle is then constructed in a series of layers on a male mould, by laying pre-cut grades of woven E-glass cloth onto the mould form and adding the slurry, working it into the fabric to ensure full wetting of the fabric. This is repeated to build up successive layers of fabric and matrix material, until the desired thickness is achieved. Each layer typically has a thickness of approximately 1 mm and the ladle shown in FIG. 1 would typically have approximately ten layers of the glass reinforcing fabric. The steel reinforcing frame is placed over the mould during the layering process, so that it becomes embedded within the composite material, between adjacent layers of the reinforcing fabric.

Once the product has achieved the desired thickness, it is removed from the mould and machined in green (unfired) form, to shape the outer surface of the body. The ladle is then placed in a furnace to dry. After drying, the product is subjected to final finishing and fettering processes, and a non-stick coating, for example of boron nitride, is applied.

The second form of the ladle shown in FIGS. 7–12 is similar in most respects to the first ladle and is constructed using a similar process. The main difference is that it has two pouring spouts 10*a*, 10*b*, which allow it to pour liquid metal simultaneously into two separate casting machines, or two parts of the same casting machine.

It will be appreciated that the ladle may take other forms, the invention not being limited to the specific forms shown in the drawings.

In use, the ladle is attached to a handling device such as a robotic arm by inserting mounting bolts through the bores 18 in the mounting blocks 16. The ladle is then used to transfer liquid aluminium from a holding furnace to a casting mould. First, the ladle is inclined backwards and the fin 14 is used to scrape any residue from the surface of the liquid metal. The ladle is then dipped into the metal so that it fills through the inlet opening 12. The ladle is then turned upright and it is lifted out of the metal, any excess metal being poured back into the furnace through the inlet opening 12. Finally, the ladle is transferred to the casting mould and the metal is poured into the mould through the spout 10.

What is claimed is:

1. A casting ladle comprising:

a body with a base and walls made of a composite ceramic material which comprises multiple layers of a woven fiber reinforcing fabric embedded within a ceramic matrix, one or more mounting blocks for attaching the ladle to a handling device, and a rigid support element embedded within the composite ceramic material between adjacent layers of woven fiber reinforcing fabric and comprising one or more mounting elements located within the mounting blocks.

2. The casting ladle according to claim 1, wherein the composite ceramic material comprises between two and twenty-five layers of reinforcing fabric.

3. The casting ladle according to claim 2, wherein the composite ceramic material comprises between four and twenty layers of reinforcing fabric.

4. The casting ladle according to claim 3, wherein the composite ceramic material comprises approximately ten layers of reinforcing fabric.

5. The casting ladle according to claim 1, wherein the reinforcing fabric comprises woven glass.

6. The casting ladle according to claim 1, wherein the matrix material is selected from the group consisting of fused silica, alumina, mullite, silicon carbide, silicon nitride, silicon aluminium oxy-nitride, zircon, magnesia, zirconia, graphite, calcium silicate, boron nitride (solid BN),aluminium nitride (AIN) and titanium diboride ($TiB_2$), and mixtures of these materials.

7. The casting ladle according to claim 1, wherein the matrix material is calcium based.

8. The casting ladle according to claim 1, wherein the matrix material comprises calcium silicate and silica.

9. The casting ladle according to claim 1, wherein the matrix material comprises wollastonite and colloidal silica.

10. The casting ladle according to claim 1, wherein the ladle comprises a non-stick surface coating.

11. The casting ladle according to claim 10, wherein the coating comprises boron nitride.

12. The casting ladle according to claim 1, wherein ladle has a wall thickness of between 5 mm and 25 mm.

13. The casting ladle according to claim 12, wherein the ladle has a wall thickness of approximately 12 mm.

14. The casting ladle according to claim 1, wherein the ladle has a capacity of between 0.5 kg and 50 kg of liquid aluminium.

15. The casting ladle according to claim 14, wherein the ladle has a capacity of between 1 kg and 20 kg of liquid aluminium.

16. The casting ladle according to claim 1, wherein the support element comprises a rigid frame element.

17. The casting ladle according to claim 1, wherein the support element is made of steel.

18. The casting ladle according to claim 1, wherein the support element comprises an elastomeric covering.

19. The casting ladle according to claim 1, wherein the support element extends around the circumference of the casting ladle.

* * * * *

UNITED STATES PATENT AND TRADEMARK OFFICE

CERTIFICATE OF CORRECTION

PATENT NO. : 7,204,955 B2
APPLICATION NO. : 10/944340
DATED : April 17, 2007
INVENTOR(S) : Mark Vincent It is certified that error appears in the above-identified patent and that said Letters Patent is hereby corrected as shown below:

Column 1, Line 31, "kg/cm3)." should be changed to --kg/$cm^3$).--

Column 2, Line 55, "(TiB2)," should be changed to --($TiB_2$),--

Column 6, Lines 14-15, "(solid BN),aluminium nitride (AIN)" should be changed to --(solid BN), aluminium nitride (A1N)--

Signed and Sealed this

Thirty-first Day of July, 2007

JON W. DUDAS
*Director of the United States Patent and Trademark Office*